United States Patent [19]

Etcheparre et al.

[11] Patent Number: 5,024,429

[45] Date of Patent: Jun. 18, 1991

[54] METHOD AND APPARATUS FOR PILING PLURAL SHEETS OF MATERIAL HAVING A REPETITIVE PATTERN THEREON, WHILE ENSURING THE VERTICAL ALIGNMENT OF THE PATTERNS FROM ONE SHEET TO THE NEXT

[75] Inventors: Jean Etcheparre; Bernard Etchparre, both of Bordeaux, France

[73] Assignee: Lectra Systemes S.A., Cestas-Bourg, France

[21] Appl. No.: 493,008

[22] Filed: Mar. 12, 1990

[30] Foreign Application Priority Data

Mar. 16, 1989 [FR] France ..... 89 03493

[51] Int. Cl.[5] ..... B65H 29/46

[52] U.S. Cl. ..... 270/30; 270/31; 414/788.9; 901/47; 38/102.91; 83/86

[58] Field of Search ..... 270/30, 31, 52; 414/788.9; 901/47; 38/137, 138, 139, 140, 102.91; 2/243 B; 112/217.1; 83/84, 86

[56] References Cited

U.S. PATENT DOCUMENTS 4,312,501 1/1982 Veith ..... 270/30

FOREIGN PATENT DOCUMENTS 859478 2/1978 Belgium .
0246393 11/1987 European Pat. Off. .
2579963 10/1986 France .
8607342 12/1986 PCT Int'l Appl. ..... 270/31
1395577 5/1988 U.S.S.R. ..... 270/52
2095217 9/1982 United Kingdom .

*Primary Examiner*—John T. Kwon
*Assistant Examiner*—Therese Newholm
*Attorney, Agent, or Firm*—Dvorak and Traub

[57] ABSTRACT

The invention uses a carriage that is longitudinally displaceable with respect to a cutting table, and a light transporting band whose width is at least equal to that of the sheets. The carriage is comprised of two separable movable members, one of which is motorized and comprises an image device for recording an optimized disposition of pieces to be cut out, while the other is towed and comprises a transversal clamping device into which is engaged a free end of the sheet. The towed member is coupled at its rear portion to the light transporting band, the latter serving to support and protect the sheet of patterned material when it is being drawn out.

12 Claims, 3 Drawing Sheets

METHOD AND APPARATUS FOR PILING PLURAL SHEETS OF MATERIAL HAVING A REPETITIVE PATTERN THEREON, WHILE ENSURING THE VERTICAL ALIGNMENT OF THE PATTERNS FROM ONE SHEET TO THE NEXT

BACKGROUND OF THE INVENTION

1. Field of the Invention

The present invention relates to a method and apparatus for piling plural sheets of material having a repetitive pattern thereon, while ensuring the vertical alignment of the patterns from one sheet to the next.

The manufacture of articles formed by a juxtaposition of several pieces cut out from sheets of patterned material generally raises some difficulties whenever it is required to match the patterns together along the assembly process. This can be the case in the tailoring industry, for example, whenever clothes are made from material having a repetitive pattern. The same problems can also occur in other fields of industry, such as: vehicle manufacturing (upholstery of car seats), furniture making and, more generally, all industries which call upon the assembly of pieces made of soft material, such as cloth, while having to maintain correct registration of the patterns.

For instance, when making an item of clothing from a patterned material, it is necessary to determine accurately the places where the patterns are to match. It will here be assumed that the dress pattern was defined at an ealier stage and that the operator possesses the corresponding templates and knows exactly the model to be produced from the work of the stylists and designers. This matching will generally be required whenever it is desired to provide continuity to the pattern while creating a three-dimensional configuration. These places are specifically marked out on the templates. The operator accordingly spreads out a ply of cloth over the table and begins to dispose the templates directly above the ply, making sure that the appropriate markers on the template coincide with the patterns on the cloth. Once this operation is completed, the operator has a layout according to which the different pieces can be cut out. He or she then proceeds to assemble the pieces together until is obtained the garment in its final form. The above procedure, while described above as a totally manual process, can of course be improved by employing known and commonly used devices for automatically grading dress patterns, cutting them out and recording the position of the templates on the cloth.

2. Prior Art

In this type of manufacturing process, the cutting out sequences are reptititive and the same operations must be re-iterated for each new ply of material. While this is perfectly acceptable for "made-to-measure" tailoring where dimensions constantly change from one garment to another, it is however inefficient when dealing with small or medium scale production runs. It is more appropriate, in the latter case, to cut out several plies at once. A number of known techniques are available for this. They are all manual and employ traditional pin tables. The operator must superimpose several plies of cloth while accurately aligning the pattern of one ply above the other. This is achieved by using pins that fix the joining points of the pattern. The pins are arranged vertically and directly on the cutting table. Depending on the working method adopted, the pins can be placed either along a master trace, or according to a standard "grid" closely matching that of the pattern. The pins are always placed before laying down the first ply of material. The operator then lays down the plies successively, pushing the pins one-by-one through each individual ply at the correct places. Since the pins are fixed, some stretching or pulling-in of material will be necessary to bring it to the required position. Although the patterns are repetitive, they never have exactly the same repetition pitch, which explains the necessity for these constant readjustments. Once the pile has been completed, the resulting wad is cut out directly on the table, after the operator has removed the pins. This is the only procedure that gives satisfactory results. However, it is completely manual, lengthy and tedious, as well as impractical and incompatible with automatic cutting machines.

SUMMARY OF THE INVENTION

The present invention makes it possible to overcome the above drawback for the first time and in a satisfactory way by teaching a method for piling, prior to a cutting-out process, a plurality of sheets of material having repetitive patterns thereon while ensuring vertical alignment of said patterns from one sheet ply to the next, said method comprising the successive steps of:

laying down a relatively rigid sheet over a cutting table;

drawing out a first sheet of material having repetitive patterns thereon from a feeding device and laying down said sheet over said relatively rigid sheet;

recording an optimized disposition of all the pieces to be cut out;

introducing vertical perforating elements at predetermined locations of said first sheet to locate the patterns.

drawing out, laying down and fixing sheets of material one by one while maintaining the superposition of the patterns by inserting said sheets through said perforating elements, the latter already being in position; wherein said drawing out and laying down of each sheet is performed automatically;

a free end of a sheet is engaged in a gripping device mounted transversally on a main, longitudinally displaceable carriage to which is attached, at a rear portion thereof, a light transporting band;

said carriage is displaced to a front end of said cutting table, whereby a certain length of material is stretched out over said table, while said material is made to rest on said light transporting band to protect said material from said perforating elements;

said gripped free end is released while being maintained over said table;

said carriage and said light transporting band are returned to a rear portion end of said table; and said material sheet is cut transversally to separate said sheet from said feeder.

In one embodiment of the present invention, the vertical perforating elements are comprised of pins intended to be removed after said piling of said plies, prior to cutting-out said plies, and after laying out said plies.

In an alternative embodiment, self-adhesive tabs are inserted through the pins to stick one ply to another.

In another alternative embodiment of the invention the perforating elements are inserted each time after a sheet is laid down, said perforating elements being insertable into each other to affix the plies together. Preferably, the perforating elements are drawing pins with self-adhesive heads made of a material that is sufficiently fragile not to hinder the cutting out process.

Another object of the present invention is to provide an apparatus for piling, prior to a cutting-out process, sheets of material having repetitive patterns thereon while ensuring vertical alignment of said patterns from one sheet ply to the next, comprising a carriage that is longitudinally movable along a cutting table and a light transporting band whose width is at least equal to that of said sheets, wherein said carriage is composed of two separable movable members, one of which is motorized and carries an image pickup device used for recording an optimized disposition of the pieces to be cut out, and the other of which is towed and comprises a transversal gripping device desired to engage a free end of said sheet, said towed member being attached, at a rear position thereof, to said transporting band intended support and protect said patterned sheet while the latter is drawn out.

In one embodiment of the present invention, the light transporting band is held taut by two longitudinally displaceable straps on either side of said cutting table, riding over return rollers at the ends of said table. The straps are attached by said towed member of said carriage and are moved therewith, driving the free end of said light transporting band supporting the sheet to be laid out.

According to another characteristic of the inventive apparatus the towed member of said carriage further comprises cutting means for separating successive sheets from a sheet feeding device after said each sheet has been laid out, said cutting means being transversally displaceable relative to said towed member. The separable members forming said carriage are assembled by means of an electromagnetic coupling device.

The present invention therefore proposes a method and apparatus for piling a plurality of sheets of material having repetitive patterns thereon, while ensuring vertical alignment of the patterns from one sheet ply to the next, so as to prepare a cutting preform as a function of the exact arrangement of the patterns, thus saving on material.

Moreover, the automation of the elementary functions considerably improves the ergonomy of the workstation. The present invention can be implemented in isolation. However, it will be used at its maximum potential and performance level when associated to an automatic cutting out machine.

BRIEF DESCRIPTION OF THE DRAWINGS

The invention shall be more clearly understood upon reading the following description of the preferred embodiments in conjunction with the appended drawings, in which.

DETAILED DESCRIPTION OF THE PREFERRED EMBODIMENTS

Figure 1:
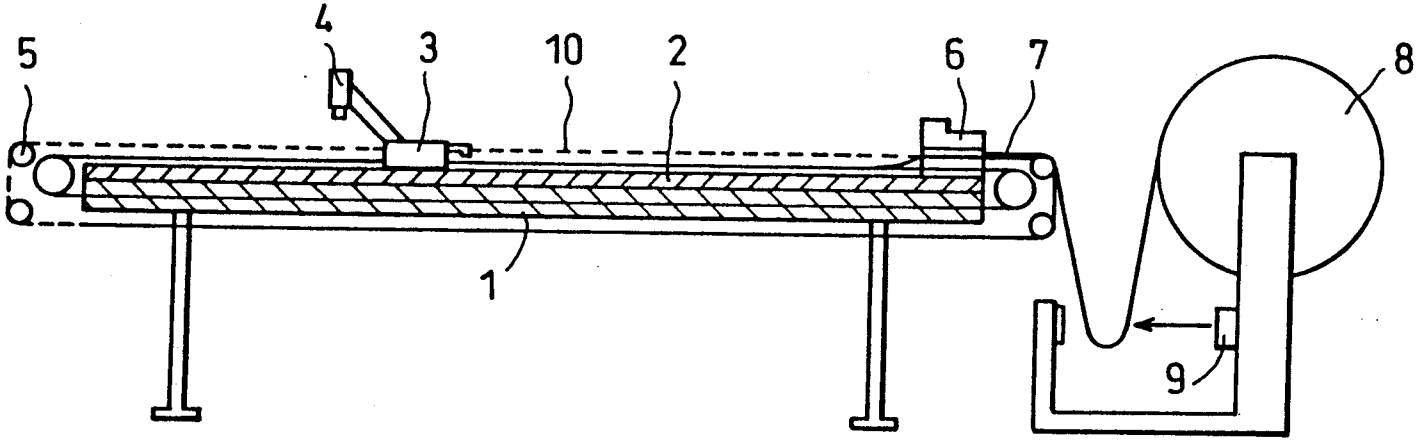
FIG. 1 is a general side view of the apparatus according to the invention.
Figure 2:
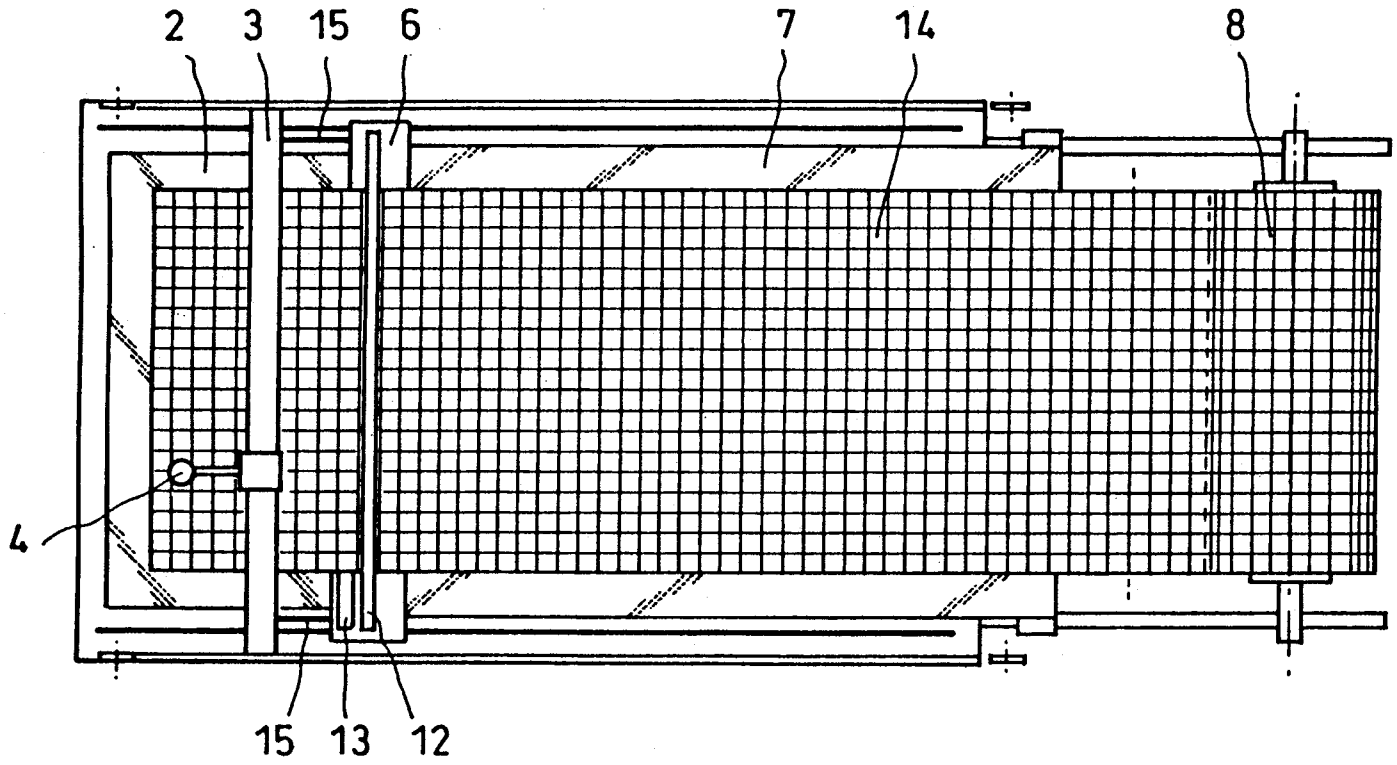
FIG. 2 is a plan view of the apparatus according to the invention.

The apparatus shown in FIGS. 1 and 2 has a main frame formed by a table, resting on the floor by legs, and having a flat surface 1 overlain with a thick rubber mat 2 or the like. A main movable carriage is arranged to be longitudinally displaceable along the table.

The carriage is composed of two separable mobile members, one 3 of which is motorized, the other 6 of which is towed.

The motorized member 3 comprises an image pickup device such as a camera 4. The camera 4 is used for recording the arrangement of patterns on the first ply of cloth.

Servo motors with speed and position feedback loops are provided to displace both the motorized member 3 along a longitudinal axis, and the camera 4 along a transversal axis.

By using an appropriately programmed numeric control, it is thus possible to displace the camera 4 to any point above the table. The presence of a camera 4 has the additional advantage of providing means for taking any defects into account, as follows. If the operators notice a defect when they spread out a ply of material, they can move the camera above the defect and appreciate its importance by superimposing the latter's image with the actual displacement. They can thus determine whether it is outside the boundaries of the pieces, in which case the defect can be ignored, or within a piece, in which case it must imperatively be eliminated or excluded from the part or the cloth in question, using classical techniques.

The towed member 6 comprises a transversal clamping device 12 devised to engage with the free end of the plies of cloth. At a rear portion of the towed member there is attached a light transporting band 7, e.g. made of Mylar, intended to support and protect the lower face of the ply as it is being drawn out.

The above light transporting band 7 is held taut by two longitudinally displaceable straps 10, on either side of the table, riding over return rollers 5 located at the ends of the table.

The band 7 is attached to the straps 10 at its free ends.

The straps 10 are attached to the lower member 6, and move therewith, driving the free end of the band 7 which thus remains constantly taut and able to support the ply to be laid down.

The towed element 6 also comprises a cutting device for separating the successive plies from the material feeding device once they have been laid down on the table. The feeding device is preferably a roll 8 placed behind the table and serving to feed out material virtually without tension. The roll 8 has a motorized shaft that transmits stop-start commands obtained via a photoelectric cell 9. A drooped portion of cloth is deliberately maintained between the roll and table to allow automatic regulation and supply of cloth onto the table. The tension in the cloth is at the most equal to the weight of the drooped portion.

After being laid out, the cloth ply is cut transversally by the cutting device, which is preferably in the form of an electrically-driven rotary blade. The blade is held in a secondary carriage that is transversally movable along the towed member 6 and fitted with an electric motor or pneumatic piston drive.

An automatic coupling device 15 is provided for coupling the motorized member 3 to the towed member 6.

The towed member 6 is placed behind the motorized member 3 and at a sufficient distance therefrom to allow the operators to work on the material unhindered.

Several known means may be used for the device 15, including electromechanical means, electromagnets or a pneumatic piston drive.

This assembly makes it possible for the towed member to be moved from one end of the table to the other, to spread out a controlled length for cloth.

Figure 3:
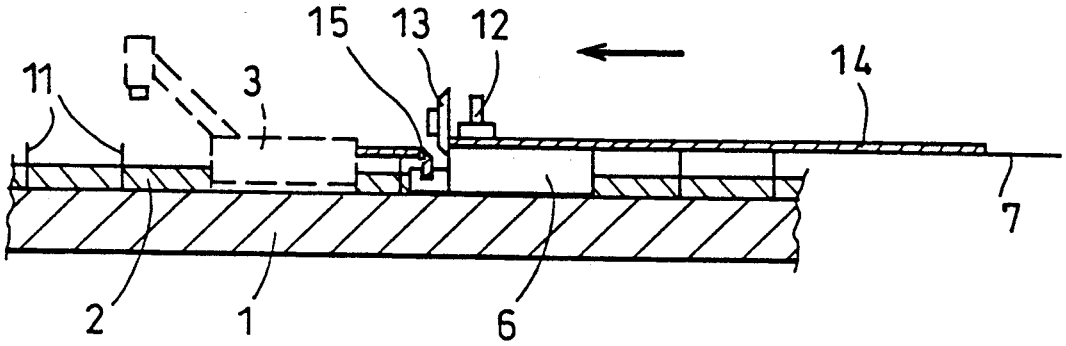
FIG. 3 shows the apparatus in an initial phase of drawing out a ply of patterned material.
Figure 4:
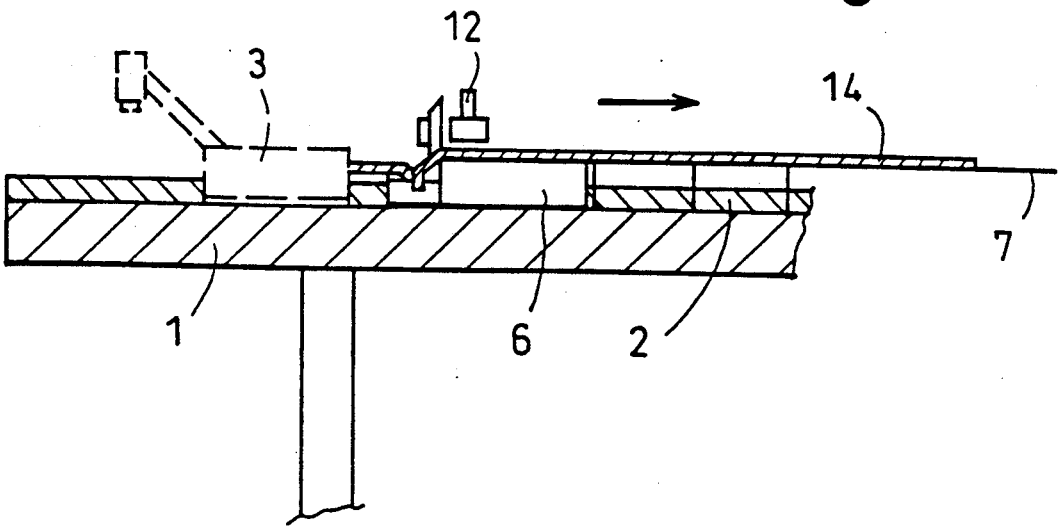
FIG. 4 shows the apparatus in a phase when the ply of FIG. 3 is laid down.

FIGS. 2 and 3 shall help understand the process steps according to the invention.

First, a relatively rigid sheet of material, such as Kraft paper or the like, is spread out on the table. This sheet supports the plies of material and serves to provide a rigid base to the wad about to be made, so as to facilitate handling. There is then spread out a first ply of material. The movable members 3, 6 are coupled by means of the coupling device to form a main movable carriage. The latter is brought to the rear position. The operators take hold of the free end of the cloth 14 and insert the latter into the clamping device 12 on member 6 of the main carriage. They then lock the device, so ensuring a firm grip of the cloth. The main carriage is sent to the front of the table and thereby draws and stretches out a certain length of cloth over the table while causing it to rest on the light transporting band 7. The clamping device 12 is then made to ungrip the free end of the material, the latter being held on the table, either manually or by mechanical means. The carriage is then returned to the rear, causing the cloth to be laid out over the table. The main carriage is stopped at a certain predetermined distance and the cloth is transversally cut by means of the blade 13 on member 6.

Once this first ply is laid out, and insofar as an automatic cutting-out machine is provided down the production line, the next step involves what shall be termed interactive positioning. This term covers the optimized positioning of all the pieces that go to form the garment, with the aim of minimizing wastage. The interactive aspect is involved when the operator decides on the layout of pieces. This can also be determined entirely automatically, using a processor to calculate the possible arrangement. The latter method makes use of computing means based on processors and display units. Before proceeding to such an operation, some preparation work is required. A "basic" positioning is initially carried out. This positioning, which is optimized, is characterized by a minimum spacing between the pieces corresponding to half the theoretical value of the material's inter-pattern pitch. This ensures that it will be possible to cut out all the pieces, with their connection points, from the thus-determined spread of cloth.

The operator searches for a corresponding recorded standard positioning format, which then appears on the screen. By overlaying this with an image of the scene viewed by the camera, the operator can see the cloth, with its patterns. Program functions at the operator's disposal enable him/her to reposition a piece exactly with respect to the pattern. The camera is displaced whenever it is necessary to reach parts that escape from the field of view.

In this way, all the pieces forming the garment are readjusted one by one. There is then obtained a positioning that corresponds precisely to the ply of material laid out. The above semi-automatic procedure can also be fully automated, in which case the computing system also calculates the displacement of the pieces from their original position, to make them correspond to the pattern.

Whichever the case, the next step consists in superimposing a number of plies of cloth, making sure that the patterns are in precise vertical alignment with the first ply of cloth laid out. To this end, vertical perforating elements (11) such as fine pins sharpened at both ends are pricked into the cloth at predetermined locations that are considered to be significant. This task relies on the operator's experience, and the number of pins used will depend on the desired quality of the superposition. To make the pins insertable, the top surface of the table is covered with a mat 2 made of rubbery material allowing easy insertion.

Once all the perforating elements 11 have been positioned, the next ply is laid out. This laying out is performed successively for each ply, from the front initial portion of the table to the rear end portion. Each time the cloth is laid out, the operators on either side of the table arrange the cloth so that the vertical perforating elements pass through the cloth at the same parts of the patterns as the first ply. This is repeated until is reached a length of cloth corresponding to the length of cloth intended to laid out. It will be noted that the laid-out surface will no longer be smooth, and the cloth can no longer be pulled directly on the table either, since it would inevitably get caught up with the perforating elements 11 and hence get damaged. To overcome this drawback, there is used a band 7 made of Mylar or the like, chosen for its lightness and tear resistance. The straps 10 move along with the main carriage to which they are attached, and pull the free end of the band 7, which remains constantly taut. The band is positioned so as to pass above the ends of the perforating element 11 when the latter are inserted into the rubber mat 2. As the main carriage is displaced, the band 7 slides on the ends of the perforating elements without becoming damaged (whence the careful choice in the material for that sheet). After being gripped by the clamping device 12, the cloth comes to rest on the smooth, continuous surface formed by the band 7. In cases where an interactive positioning is obtained from the real-life patterns, knowledge of the exact length of the wad, as determined by the processor, will allow the plies to be cut at optimum lengths, so saving on material in comparison with the conventional method. Once the wad is completed, the operators remove the perforating elements and manually transfer the wad to a cutting table by sliding, taking care to pull only on the paper—or other material—backing. This is important since otherwise there could be relative movement between the plies, which would destroy the vertical alignment of the patterns.

If the wad does not support handling well, several solutions may be employed to join the plies to each other, at the expense of a slight lengthening of the operating cycle. The first solution consists in using simple circular paper tabs that are self-adhesive on both faces. Every time the cloth is pushed through a pin, there is added one of the above tabs at the same place, also pushed through the pin. Thus, when the following ply is laid out, there will be adhesion between the two plies at those sites. When the pins are removed, the different plies will remain stuck together. These tabs are made of soft material, and accordingly if they got in the way of the blade during the cutting out, they would be severed without any problem.

An alternative solution consists in using drawing pins with self-adhesive heads, that are insertable into each other. Once the first ply of cloth has been laid down, the above drawing pins are arranged in the same way as the pins. They remain in place by virtue of their self-adhesive heads. Upon laying down the following plies of cloth, a new drawing pin is set inside the one previously put into place, and so on. This solution is time saving since there is no need to remove all the pins once all the plies of cloth have been laid down. Also, this solution obviates the need to have a rubbery mat on the table. These drawing pins can also be made of material that can easily be severed by the cutting blade, should they be in its path.

What is claimed is:

1. A method for piling, prior to a cutting-out process, a plurality of sheets of material having repetitive patterns theron while ensuring vertical alignment of said patterns from one sheet ply to the next, said method comprising the successive steps of:

laying down a relatively rigid sheet over a cutting table;

drawing out a first sheet of material having repetitive patterns thereon from a feeding device and laying down said sheet over said relatively rigid sheet;

recording an optimized disposition of all the pieces to be cut out;

introducing vertical perforating elements at predetermined locations of said first sheet to locate the patterns;

drawing out, laying down and fixing sheets of material one by one while maintaining the superposition of the patterns by inserting said sheets through said perforating elements, the latter already being in position; wherein:

said drawing out and laying down of each sheet is performed automatically;

a free end of a sheet is engaged in a gripping device mounted transversally on a main, longitudinally displaceable carriage to which is attached, at a rear portion thereof, a light transporting band;

said carriage is displaced to a front end of said cutting table, whereby a certain length of material is stretched out over said table, while said material is made to rest on said light transporting band to protect said material from said perforating elements;

said gripped free end is released while being maintained over said table;

said carriage and its light transporting band are returned to a rear portion end of said table; and said material sheet is cut transversally to separate said sheet from said feeder.

2. A method as claimed in claim 1, wherein said vertical perforating elements are comprised of pins intended to be removed after said piling of said plies and prior to cutting-out said pieces.

3. A method as claimed in claim 2, wherein after laying down a ply there is inserted a self-adhesive tab through said pins so as to stick one plug to another.

4. A method as claimed in claim 2, wherein said perforating elements are inserted after each time a sheet is laid down, said perforating elements being insertable into each other to affix the plies together.

5. A method as claimed in claim 4, wherein said perforating elements are drawing pins with self-adhesive heads made of a material that is sufficiently fragile not to hinder the cutting out process.

6. An apparatus for piling, prior to a cutting-out process, sheets of material having repetitive patterns thereon while ensuring vertical alignment of said patterns from one sheet ply to the next, comprising a carriage that is longitudinally movable along a cutting table and a light transporting band whose width is at least equal to that of said sheets, wherein said carriage is composed of two separable movable members, one of which is motorized and carries an image pickup device used for recording an optimized disposition of the pieces to be cut out, and the other of which is towed and comprises a transversal gripping device devised to engage a free end of said sheet, said towed member being attached, at a rear portion thereof, to said transporting band intended support and protect said patterned sheet while the latter is drawn out.

7. An apparatus as claimed in claim 6, wherein said light transporting band is held taut by two longitudinally displaceable straps on either side of said cutting table that ride over return rollers at the ends of said table.

8. An apparatus as claimed in claim 6, wherein said straps are attached to said towed member of said carriage and move therewith driving the free end of said light transporting band supporting the sheet to be laid out.

9. An apparatus as claimed in claim 6, wherein the towed member of said carriage further comprises cutting means for separating successive sheets from a sheet feeding device after said each sheet has been laid out, said cutting means being transversally displaceable relative to said towed member.

10. An apparatus as claimed in claim 6, wherein said separable members forming said carriage are assembled by means of an electromagnetic coupling device.

11. An apparatus as claimed in claim 6, wherein said apparatus further comprises a feeding means for feeding patterned sheet material substantially without tension.

12. An apparatus as claimed in claim 6, wherein said light transporting band is made of Mylar.

* * * * *